US009546070B2

(12) United States Patent
Hollands et al.

(10) Patent No.: US 9,546,070 B2
(45) Date of Patent: Jan. 17, 2017

(54) SHEET HANDLING APPARATUS WITH ROTARY DRUM

(71) Applicant: Océ-Technologies B.V., Venlo (NL)

(72) Inventors: Peter J. Hollands, Venlo (NL); Erik E. M. Nolting, Venlo (NL)

(73) Assignee: OCÉ-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/956,027

(22) Filed: Dec. 1, 2015

(65) Prior Publication Data

US 2016/0152046 A1 Jun. 2, 2016

(30) Foreign Application Priority Data

Dec. 2, 2014 (EP) ..... 14195915

(51) Int. Cl.

| | |
|---|---|
| ***B65H 81/00*** | (2006.01) |
| ***B41F 21/10*** | (2006.01) |
| ***B41F 23/04*** | (2006.01) |
| ***B41J 11/02*** | (2006.01) |
| ***B41J 11/00*** | (2006.01) |
| ***B65H 5/22*** | (2006.01) |
| ***B41J 13/22*** | (2006.01) |

(52) U.S. Cl.

CPC ..... *B65H 81/00* (2013.01); *B41F 21/102* (2013.01); *B41F 23/044* (2013.01); *B41J 11/002* (2013.01); *B41J 13/226* (2013.01); *B65H 5/226* (2013.01); *G03G 2215/00666* (2013.01)

(58) Field of Classification Search

CPC ..... B65H 81/00; B65H 5/226; B41J 13/226; B41J 11/002; B41F 21/102; B41F 23/044; G03G 2215/00666

See application file for complete search history.

(56) References Cited

U.S. PATENT DOCUMENTS

2005/0092200 A1* 5/2005 Beauchamp et al. .. B41J 13/226 101/409

FOREIGN PATENT DOCUMENTS

| | | | |
|---|---|---|---|
| EP | 1527893 | A1 | 5/2005 |
| JP | 2010-126269 | A | 6/2010 |
| WO | WO 2013/131751 | A1 | 9/2013 |

* cited by examiner

*Primary Examiner* — Bradley Thies
(74) *Attorney, Agent, or Firm* — Birch, Stewart, Kolasch & Birch, LLP

(57) ABSTRACT

According to the present invention a sheet handling apparatus is provided which comprises a rotary drum with openings at its peripheral wall. A strip with perforations formed therein spirals circumferentially over an outer surface of the drum in a circumferential spiralling direction, such that a screen is formed over the drum. A suction system controls a flow of air through the perforations thereby to attract sheets towards the drum. The strip is biased by means of a tensioning assembly, which exerts a tensioning force on the strip substantially parallel to the circumferential spiralling direction of the strip.

15 Claims, 7 Drawing Sheets

SHEET HANDLING APPARATUS WITH ROTARY DRUM

BACKGROUND OF THE INVENTION

1. Field of the Invention

The invention relates to a drying drum assembly for a sheet handling apparatus and a method for the production thereof.

2. Description of Background Art

In high capacity printing systems (>200 sheets per minute) the proper drying of freshly printed sheets is critical. After leaving the print head the ink on the sheets is wet and able to contaminate parts of the printing system or other sheets by contact. These wet sheets cannot be stacked or flipped for duplex printing, but need to dry first. Therefore, after printing, the sheets are transported towards a sheet handling apparatus with a rotatable drying drum, against the outer surface of which the sheets are temporarily adhered. The drum can is heated e.g. by infrared lights, to speed up the drying process. Since the drum rotates the sheet flow is not interrupted, allowing for a continuous printing process. After drying the sheets disengage from the drum and are transported towards for example a stacking unit or redirected to the print head to be duplex printed on their blank sides.

Such a rotary drum has an outer peripheral wall with openings formed therein. A circumferential screen is provided over the outer surface of the drum. The screen comprises perforations. A suction system controls a flow of air through the openings of the drum and the perforations of the screen to attract sheets towards the peripheral wall of the drum, such that the sheets can be removably fixed to the screen.

Due to the heating applied for drying the sheets, the screen and drum also become heated. Since the drum and screen are often formed of different materials, differences in thermal expansion can result in releasing the screen from the drum. To prevent this release such screens are glued securely to the drum.

Drawback of the above described sheet handling apparatus is that the screen cannot be easily replaced. Additionally, the production of such a sheet handling apparatus is relatively complex.

SUMMARY OF THE INVENTION

It is an object of the present invention to provide an improved drying drum assembly for a sheet handling apparatus, which can be easily assembled and maintained.

The object of the present invention is achieved by a drying drum assembly according to claim 1. The drying drum assembly according to the present invention comprises a rotary drum having an outer peripheral wall provided with openings. A strip with perforations formed therein is provided, which strip spirals circumferentially over the outer surface of the peripheral wall of the drum in a circumferential spiralling direction, such that a screen is formed over the peripheral wall of the drum. The openings of the drum and the perforations of the strip are positioned with respect to one another for a fluid connection to one another and for a fluid connection to suction system. This suction system may then control a flow of air through the openings of the drum and the perforations of the screen, such that the sheets may be removably fixed on the screen. The strip is biased by means of a tensioning device, which exerts a tensioning force on the strip substantially parallel to the circumferential spiralling direction of the strip.

To ensure proper drying of the sheets and to simultaneously maintain the high through put speed required for high capacity printing, the drum is preferably sufficiently large to allow the sheets to dry while on the drum. The diameter of the drum may be significantly larger than the sheet length of the sheets drying on it. During operation the drum holds a plurality of sheets, for example more than 5 or preferably more than 10. Sheets may then be transported from the image forming unit to the drum by means of a first transport mechanism. The drum may pick up the sheets from the first transport mechanism, where the sheets are held onto screen via vacuum forces working through the perforations. The sheets may then be carried in a rotational motion preferably over the majority of a single turning of the drum (i.e less than 360°), during which time the sheets may be dried by exposure to radiation heaters. When dried, the sheets may leave the drum to be transported via a second transport mechanism either to a finisher unit or back towards the image forming unit for duplex printing.

The strip revolves around the drum, for example, from one end of the drum to the other end in multiple adjoining loops, preferably covering the majority of the outer surface of the peripheral wall. It is the insight of the inventors that any slack in a strip spiralling over the surface of the drum for forming a screen can be compensated by a tensioning force in the circumferential spiralling direction of the strip. The strip is secured to the drum by the tensioning device, which preferably pulls on the strip in either the clockwise or counter clockwise circumferential spiralling direction. Basically the tensioning device pulls on the strip in the direction wherein the strip is wound around the drum. The tensioning device provides a continuously present force on the strip to drive or pull the strip against the peripheral wall of the drum. When differences in the thermal expansion of the drum and screen occur, the strip is kept pressed against the drum by the tensioning device, effectively preventing a (partial) release of the screen from the drum.

Since the screen according to the present invention need not be permanently adhered to the screen production and maintenance are relatively simple. The step of gluing the screen to the drum as known from the prior art is not required in an assembly according to the present invention. Thereby, a sheet handling apparatus comprising a drying drum assembly according to the present invention is easier to produce. Since the screen need not be permanently fixed to the drum by glue, the screen may easily be replaced by removing the strip present on the drum and wrapping a new strip around the drum. As such the drying drum assembly is easy to maintain, since the screen can be easily replaced, if required. Thereby, the object of the present invention has been achieved.

More specific optional features of the invention are indicated in the dependent claims.

In an exemplary embodiment, the perforations in the screen and the openings of the drum are radially aligned for a fluid connection between one another. The perforations in the screen are then positioned radially outward with respect to the openings of the drum. The perforations for example (partially) overlap the openings when viewed in the radial direction. Thereto, the openings of the drum may be larger in size (e.g. diameter) than the perforations in the screen, such that for example one or more screen perforations may be overlapped or covered by a single drum opening. Air is then able to flow from outside the drum, through the perforations in the screen to and through the openings of the drum towards the suction system. The air may be sucked in via the perforations by means of a suction system.

In a preferred embodiment, the periphery or the inside of the drum comprises one or more hollow chambers or channels connectable to a suction system, such as a pump or fan for creating an underpressure in the chamber. The hollow chamber and thus the pump or fan may be in fluid connection to the outside of the drum via the openings in the peripheral wall of the drum and the perforations in the screen. As such, air can be sucked through the openings into the drum and the perforations in the screen, thereby to attract sheets towards screen. The perforations in the strip are preferably smaller in area or cross-section than the openings in the peripheral wall of the drum. Via the openings in the peripheral wall of the drum and the perforations in the screen in fluid connection therewith sheets can be efficiently held against the drum via suction.

In a preferred embodiment, the drying drum assembly according to the present invention further comprises air channels provided on the peripheral wall of the drum, which air channels are delimited by the screen. Therein, the openings of the drum are formed by said air channels. As such, the peripheral wall of the drum may comprise one or more air channels, which may for example be open in the radially outward direction for forming the openings. Said air channels extend along the inner surface of the screen, preferably in the axial direction. The air channels may extend from one axial end of the drum to the other axial end of the drum. The air channels are arranged for a fluid connection to the suction system. A manifold is preferably provided in or on the drum, for example as a disk-shaped manifold positioned at an axial end of the drum. The manifold thus connects the air channels to the suction system.

In another embodiment, the strip is wrapped around the drum to form a screen preferably over the majority of the peripheral wall of the drum. Preferably, no spacing is present between adjacent loops for forming a relatively smooth surface. In a preferred embodiment, the strip is provided over the air channels, such that the perforations are in fluid connection with the air channels. Air may then pass through the perforations preferably directly into the air channels, which may be connected to the suction system for providing an underpressure in the air channels. Said underpressure in the air channels effectively sucks the air in through the perforations and provides a suction force on the sheets on the screen.

In a preferred embodiment, the tensioning device is positioned at an end of the strip. The tensioning device is arranged to pull on the strip substantially in the direction in which the strip extends around the drum. This allows advantageously for positioning the tensioning device without affecting the strip and thereby interrupting the screen. In one exemplary embodiment, one end of the strip is engaged by a tensioning device, while the other end of the strip is secured to the drum, e.g. by means of a clamp, fastener, or weld. In another example, tensioning devices may be applied to either end of the strip.

In an embodiment the tensioning assembly comprises a tensioning device at each end of the strip. The tensioning devices are oriented in substantially opposite directions to one another in the circumferential spiralling direction of the strip. Basically, one tensioning device pulls on the strip in the substantially clockwise direction, while the other tensioning device at the other end of the strip pulls in the substantially counter clockwise direction. The tensioning devices thus secure and pull on the longitudinal strip, such that their pulling forces are aimed against one another, as seen in the circumferential direction of the drum. Due to the fact that the strip is being pulled at both its ends, the strip is wrapped tightly around the outer surface of the drum. The tensioning devices keep the strip under tension and thus pressed against the drum, even when thermal expansion differences between the drum and strip cause changes in the tension in the strip. For example, when during drying the sheets are heated, the strip and the drum are also heated. The screen formed by the strip might expand more than the drum. To prevent slacking of the strip, the tensioning devices keep the strip under tension, pulling it against the outer surface of the drum. The tensioning devices thereby provide an effective means of holding the screen wrapped around the drum during both heating and cooling.

Preferably the width of the strip is small compared to the diameter of the drum. The strip then revolves a plurality of times around the drum (e.g. 10 revolutions or more). The spiralling direction of the strip substantially corresponds to the circumferential direction of the drum, especially when the strip is narrow. The clockwise and counter clockwise forces working on the strip can as such be defined with respect to the circumferential direction of the drum as well as the circumferential spiralling direction of the strip. It lies within the scope of the present invention to offset the direction of the tensioning forces by a small angle with respect to the circumferential direction of the drum, for example by an offset angle in the range of an angle by which the circumferential spiralling direction of the strip deviates from the circumferential direction of the drum.

In an embodiment the tensioning device comprises a lever pivotably provided on the drum. Preferably the lever is substantially located inside the drum for forming a compact construction and keeping the outer surface of the drum free and/or smooth. The lever is connected to the drum via a spring element. The spring element during operation exerts a force on the lever. The lever transmits this force to the strip, which is connected to the lever. Preferably, the lever comprises a pivoting axis connected to the drum and substantially parallel to a rotation axis of the drum. This construction allows for a compact and durable tensioning assembly.

In an embodiment the spring element during operation is arranged for exerting a continuous pulling force in the circumferential spiralling direction on the end of the strip via the lever. The spring element is biased, such that in the case of thermal expansion differences between the drum and the strip, the spring element is able to supply a tensioning force for holding the strip onto the drum.

In an embodiment a tensioning device is positioned near either end of the drum. The strip is spiralled around the drum, such that one end of the strip is near an edge of a first end of the drum, while the other end of the strip is near an edge of a second end of the drum. Basically the strip spirals from one end of the drum to the other. The tensioning devices engage the ends of the strips near the edges of the drum.

In an embodiment the tensioning device further comprises stop elements adjacent the edges of the screen for limiting the axial movement of the strip over the outer peripheral wall of the drum. As such, any axial movement of the screen over the outer surface of the drum is prevented and the different revolutions of the strip are kept pressed together. This prevents spacing between adjacent edges of subsequent revolutions of the strip. Preferably, the stop elements are positioned near the edges at the ends of the drum.

In an embodiment the stop elements are spaced circumferentially apart from one another. A plurality of stop elements is positioned at a distance from one another along each edge of the drum adjacent the edges of the screen. The stop elements are connected to the drum and in contact with the edges of the screen. Preferably the stop elements are adjustable, so that variations in the width of the screen and/or the strip can be overcome. The stop elements effectively limit the movement of the strip to substantially the circumferential (spiralling) direction. Axial "wandering" of the strip is thereby effectively prevented.

In an embodiment, the strip and drum are formed of materials having different thermal expansion coefficients. A smooth perforated outer surface can be easily and cheaply formed by the strip, whereas the drum can be produced by a different method. This eases the production of a drying drum assembly according to the present invention.

In another aspect, the invention provides a sheet handling apparatus which comprises a drying drum assembly according to the present invention, and a suction system for controlling a flow of air through the openings of the drum and the perforations of the strip, thereby to attract sheets towards the peripheral wall of the drum, such that the sheets are removably fixed on the screen. The suction system may be in fluid connection with the openings of the drum and strip to apply a suction force to the sheets on the drum.

In another aspect, the invention provides a sheet handling apparatus which comprises drying drum assembly according to the present invention and a heating system for heating the sheets on the drum. The heating system accelerates the drying of the sheets, allowing for example the drum dimensions to be reduced. Preferably the heating system comprises radiation heaters positioned substantially circumferentially around the drum to allow for contactless heating of the sheets.

In an embodiment the strip and the outer surface of the drum are arranged for a free, preferably substantially frictionless, sliding motion of the strip over de outer surface of the drum. Low friction allows the strip to slide over the drum and prevent an uneven distribution of the tensioning forces throughout the strip. Substantially frictionless contact ensures a proper holding of the screen against the drum. Thereto the outer surface of the drum and the strip are preferably smooth. Preferably the outer surface of the drum and/or a surface of the strip have been treated to minimize friction between the outer surface of the drum and the strip, preferably by means of polishing, sanding, and/or anodizing.

The present invention further relates to a printing system comprising a sheet handling apparatus according to the present invention.

The present invention further relates to a method for producing a drying drum assembly for a sheet handling apparatus according to the present invention, the method comprising the steps of:

- attaching a first end of a longitudinal strip formed of a first material to a first tensioning device, preferably at an outer surface of a drum, formed of a second material,
- wrapping the strip around the outer surface of the drum in a pattern spiralling over the outer surface of the drum, such that a screen is formed over at least part of the outer surface of the drum,
- attaching a second end of a longitudinal strip to a second tensioning device, preferably at the outer surface of the drum, such that the strip is biased in the circumferential spiralling direction of the strip by means of the tensioning devices.

Preferably the first material is different from the second material, specifically the first and second materials possess different thermal expansion characteristics. The drum can be formed of a metal, such aluminium, whereas the strip and thus the screen may be formed of a different metal, such as (anodized) steel. Additionally the method can include the step of pressing the first revolution of the strip against stop elements provided near one end of the drum, and the step of using adjustable stop elements on the other end of the drum for pressing and holding the revolutions of the strip wrapped around the drum together.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

Figure 1:
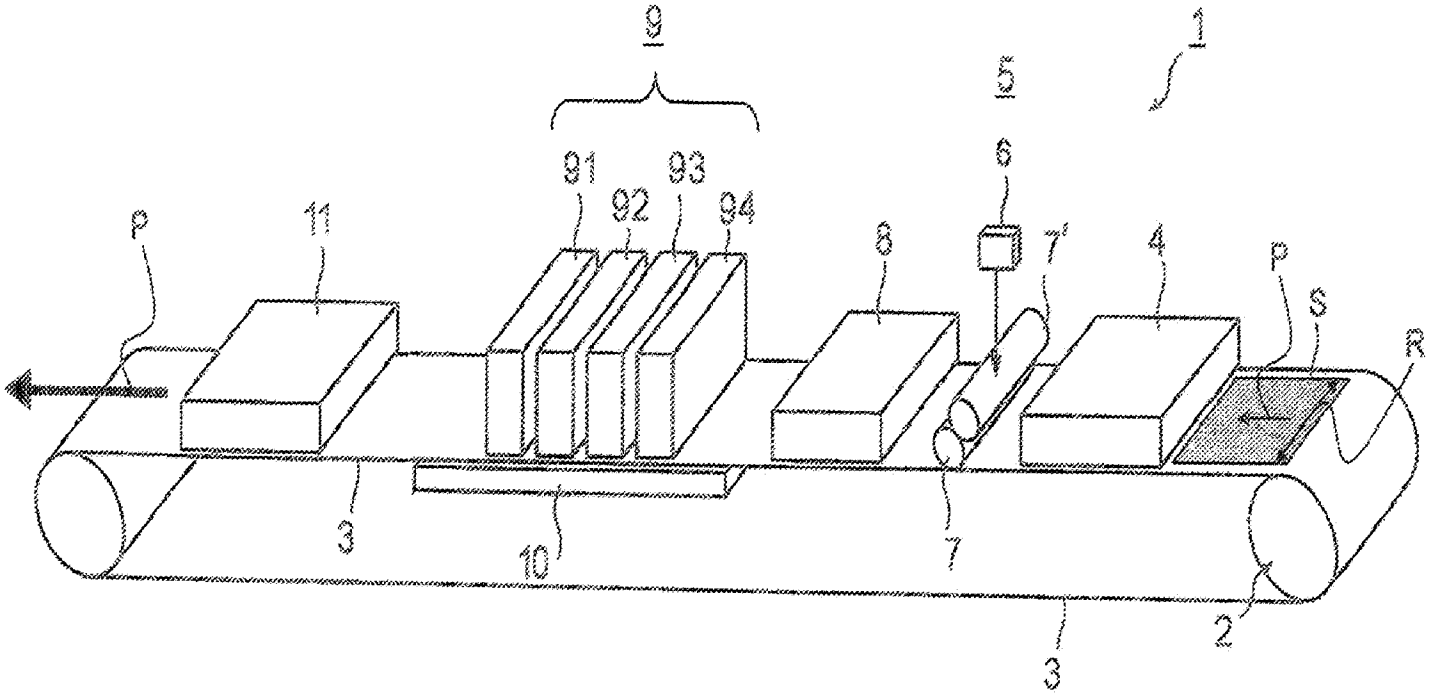
FIG. 1 is a schematic side view of part of a printing system according to an embodiment of the invention.

The accompanying drawings are included to provide a further understanding of the present invention and are incorporated in and constitute a part of this specification. The drawings illustrate particular embodiments of the invention and together with the description serve to explain the principles of the invention. Other embodiments of the invention and many of the attendant advantages of the invention will be readily appreciated as they become better understood with reference to the following detailed description.

It will be appreciated that common and/or well understood elements that may be useful or necessary in a commercially feasible embodiment are not necessarily depicted in order to facilitate a more abstracted view of the embodiments. The elements of the drawings are not necessarily illustrated to scale relative to each other. It will further be appreciated that certain actions and/or steps in an embodiment of a method may be described or depicted in a particular order of occurrences while those skilled in the art will understand that such specificity with respect to sequence is not actually required. It will also be understood that the terms and expressions used in the present specification have the ordinary meaning as is accorded to such terms and expressions with respect to their corresponding respective areas of inquiry and study, except where specific meanings have otherwise been set forth herein.

DETAILED DESCRIPTION OF THE PREFERRED EMBODIMENTS

The present invention will now be described with reference to the accompanying drawings, wherein the same reference numerals have been used to identify the same or similar elements throughout the several views.

With reference to FIG. 1 of the drawings, a portion of an inkjet printing system 1 according to a preferred embodiment of the invention is shown. FIG. 1 illustrates in particular the following parts or steps of the printing process in the inkjet printing system 1: media pre-treatment, image formation, drying and fixing and optionally post treatment. Each of these will be discussed briefly below.

FIG. 1 shows that a sheet S of a receiving medium or print medium, in particular a machine-coated print medium, is transported or conveyed along a transport path P of the system 1 with the aid of transport mechanism 2 in a direction indicated by arrows P. The transport mechanism 2 may comprise a driven belt system having one or more endless belt 3. Alternatively, the belt(s) 3 may be exchanged for one or more drums. The transport mechanism 2 may be suitably configured depending on the requirements of the sheet transport in each step of the printing process (e.g. sheet registration accuracy) and may hence comprise multiple driven belts 3, 3' and/or multiple drums. For a proper conveyance of the sheets S of the receiving medium or print medium, the sheets S should be fixed to or held by the transport mechanism 2. The manner of such fixation is not limited and may, for example, be selected from the group: electrostatic fixation, mechanical fixation (e.g. clamping) and vacuum fixation, of which vacuum fixation is particularly preferred.

Media Pre-Treatment

To improve spreading and pinning (i.e. fixation of pigments and water-dispersed polymer particles) of the ink on the print medium, in particular on slow absorbing media, such as machine-coated media, the print medium may be pre-treated, i.e. treated prior to the printing of an image on the medium. The pre-treatment step may comprise one or more of the following:

pre-heating of the print medium to enhance spreading of the ink used on the print medium and/or to enhance absorption into the print medium of the ink used;

(ii) primer pre-treatment for increasing the surface tension of print medium in order to improve the wettability of the print medium by the ink used and to control the stability of the dispersed solid fraction of the ink composition, i.e. pigments and dispersed polymer particles; (N.B. primer pre-treatment can be performed in a gas phase, e.g. with gaseous acids such as hydrochloric acid, sulphuric acid, acetic acid, phosphoric acid and lactic acid, or in a liquid phase by coating the print medium with a pre-treatment liquid. A pre-treatment liquid may include water as a solvent, one or more co-solvents, additives such as surfactants, and at least one compound selected from a polyvalent metal salt, an acid and a cationic resin); and (iii) corona or plasma treatment.

FIG. 1 illustrates that the sheet S of print medium may be conveyed to and passed through a first pre-treatment module 4, which module may comprise a preheater, (e.g. a radiation heater), a corona/plasma treatment unit, a gaseous acid treatment unit or a combination of any of these. Subsequently, a predetermined quantity of the pre-treatment liquid may optionally be applied on a surface of the print medium via a pre-treatment liquid applying device 5. Specifically, the pre-treatment liquid is provided from a storage tank 6 to the pre-treatment liquid applying device 5, which comprises double rollers 7, 7'. A surface of the double rollers 7, 7' may be covered with a porous material, such as sponge. After providing the pre-treatment liquid to auxiliary roller 7' first, the pre-treatment liquid is transferred to main roller 7, and a predetermined quantity is applied onto the surface of the print medium. Thereafter, the coated printing medium (e.g. paper) onto which the pre-treatment liquid was applied may optionally be heated and dried by a dryer device 8, which comprises a dryer heater installed at a position downstream of the pre-treatment liquid applying device 5 in order to reduce the quantity of water content in the pre-treatment liquid to a predetermined range. It is preferable to decrease the water content in an amount of 1.0 weight % to 30 weight % based on the total water content in the pre-treatment liquid provided on the print medium sheet S. To prevent the transport mechanism 2 from being contaminated with pre-treatment liquid, a cleaning unit (not shown) may be installed and/or the transport mechanism 2 may include a plurality of belts or drums 3, 3', as noted above. The latter measure avoids or prevents contamination of other parts of the printing system 1, particularly of the transport mechanism 2 in the printing region.

It will be appreciated that any conventionally known methods can be used to apply the pre-treatment liquid. Specific examples of an application technique include: roller coating (as shown), ink-jet application, curtain coating and spray coating. There is no specific restriction in the number of times the pre-treatment liquid may be applied. It may be applied just one time, or it may be applied two times or more. An application twice or more may be preferable, as cockling of the coated print medium can be prevented and the film formed by the surface pre-treatment liquid will produce a uniform dry surface with no wrinkles after application twice or more. A coating device 5 that employs one or more rollers 7, 7' is desirable because this technique does not need to take ejection properties into consideration and it can apply the pre-treatment liquid homogeneously to a print medium. In addition, the amount of the pre-treatment liquid applied with a roller or with other means can be suitably adjusted by controlling one or more of: the physical properties of the pre-treatment liquid, the contact pressure of the roller, and the rotational speed of the roller in the coating device. An application area of the pre-treatment liquid may be only that portion of the sheet S to be printed, or an entire surface of a print portion and/or a non-print portion. However, when the pre-treatment liquid is applied only to a print portion, unevenness may occur between the application area and a non-application area caused by swelling of cellulose contained in coated printing paper with water from the pre-treatment liquid followed by drying. From a view-point of uniform drying, it is thus preferable to apply a pre-treatment liquid to the entire surface of a coated printing paper, and roller coating can be preferably used as a coating method to the whole surface. The pre-treatment liquid may be an aqueous liquid.

Corona or plasma treatment may be used as a pre-treatment step by exposing a sheet of a print medium to corona discharge or plasma treatment. In particular, when used on media such as polyethylene (PE) films, polypropylene (PP) films, polyethylene terephthalate (PET) films and machine coated media, the adhesion and spreading of the ink can be improved by increasing the surface energy of the medium. With machine-coated media, the absorption of water can be promoted which may induce faster fixation of the image and less puddling on the print medium. Surface properties of the print medium may be tuned by using different gases or gas mixtures as medium in the corona or plasma treatment. Examples of such gases include: air, oxygen, nitrogen, carbon dioxide, methane, fluorine gas, argon, neon, and mixtures thereof. Corona treatment in air is most preferred.

Image Formation

When employing an inkjet printer loaded with inkjet inks, the image formation is typically performed in a manner whereby ink droplets are ejected from inkjet heads onto a print medium based on digital signals. Although both single-pass inkjet printing and multi-pass (i.e. scanning) inkjet printing may be used for image formation, single-pass inkjet printing is preferable as it is effective to perform high-speed printing. Single-pass inkjet printing is an inkjet printing method with which ink droplets are deposited onto the print medium to form all pixels of the image in a single passage of the print medium through the image forming device, i.e. beneath an inkjet marking module.

Referring to FIG. 1, after pre-treatment, the sheet S of print medium is conveyed on the transport belt 3 to an image forming device or inkjet marking module 9, where image formation is carried out by ejecting ink from inkjet marking device 91, 92, 93, 94 arranged so that a whole width of the sheet S is covered. That is, the image forming device 9 comprises an inkjet marking module having four inkjet marking devices 91, 92, 93, 94, each being configured and arranged to eject an ink of a different colour (e.g. Cyan, Magenta, Yellow and Black). Such an inkjet marking device 91, 92, 93, 94 for use in single-pass inkjet printing typically has a length corresponding to at least a width of a desired printing range R (i.e. indicated by the double-headed arrow on sheet S), with the printing range R being perpendicular to the media transport direction along the transport path P.

Figure 2:
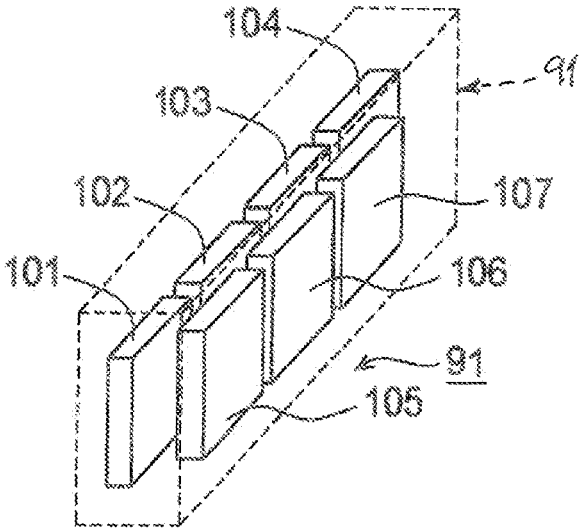
FIG. 2 is a schematic perspective view of an image forming device in the printing system of FIG. 1.
Figure 3A:
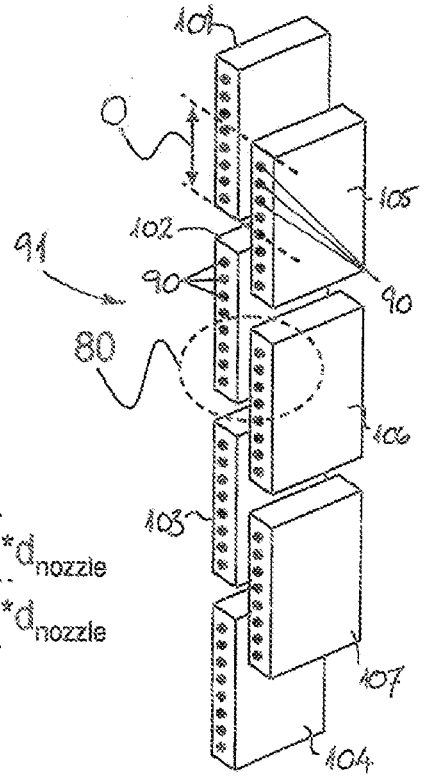
FIG. 3A is a schematic perspective underside view of printing heads in the image forming device of FIG. 2.
Figure 3B:
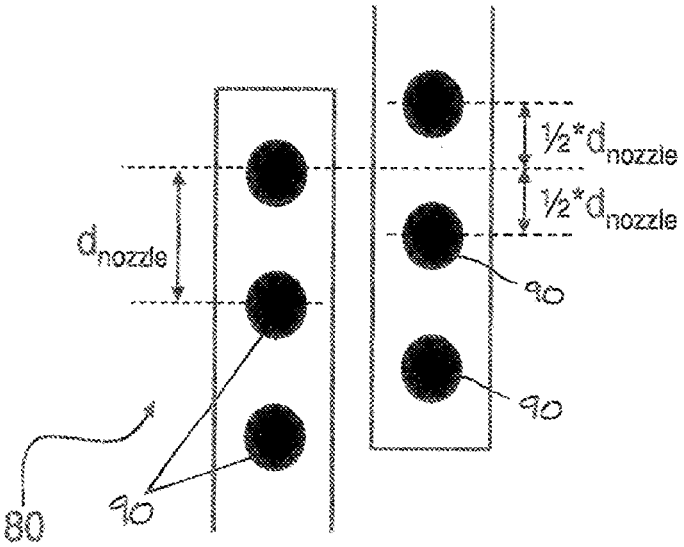
FIG. 3B is a detailed view of the printing heads in the image forming device of FIG. 2 and FIG. 3A.

Each inkjet marking device 91, 92, 93, 94 may have a single print head having a length corresponding to the desired printing range R. Alternatively, as shown in FIG. 2, the inkjet marking device 91 may be constructed by combining two or more inkjet heads or printing heads 101-107, such that a combined length of individual inkjet heads covers the entire width of the printing range R. Such a construction of the inkjet marking device 91 is termed a page wide array (PWA) of print heads. As shown in FIG. 2, the inkjet marking device 91 (and the others 92, 93, 94 may be identical) comprises seven individual inkjet heads 101-107 arranged in two parallel rows, with a first row having four inkjet heads 101-104 and a second row having three inkjet heads 105-107 arranged in a staggered configuration with respect to the inkjet heads 101-104 of the first row. The staggered arrangement provides a page-wide array of inkjet nozzles 90, which nozzles are substantially equidistant in the length direction of the inkjet marking device 91. The staggered configuration may also provide a redundancy of nozzles in an area O where the inkjet heads of the first row and the second row overlap. (See in FIG. 3A). The staggering of the nozzles 90 may further be used to decrease an effective nozzle pitch d (and hence to increase print resolution) in the length direction of the inkjet marking device 91. In particular, the inkjet heads are arranged such that positions of the nozzles 90 of the inkjet heads 105-107 in the second row are shifted in the length direction of the inkjet marking device 91 by half the nozzle pitch d, the nozzle pitch d being the distance between adjacent nozzles 90 in an inkjet head 101-107. (See FIG. 3B, which shows a detailed view of 80 in FIG. 3A). The nozzle pitch d of each head is, for example, about 360 dpi, where "dpi" indicates a number of dots per 2.54 cm (i.e. dots per inch). The resolution may be further increased by using more rows of inkjet heads, each of which are arranged such that the positions of the nozzles of each row are shifted in the length direction with respect to the positions of the nozzles of all other rows.

In the process of image formation by ejecting ink, an inkjet head or a printing head employed may be an on-demand type or a continuous type inkjet head. As an ink ejection system, an electrical-mechanical conversion system (e.g. a single-cavity type, a double-cavity type, a bender type, a piston type, a shear mode type, or a shared wall type) or an electrical-thermal conversion system (e.g. a thermal inkjet type, or a Bubble Jet® type) may be employed. Among them, it is preferable to use a piezo type inkjet recording head which has nozzles of a diameter of 30 μm or less in the current image forming method.

The image formation via the inkjet marking module 9 may optionally be carried out while the sheet S of print medium is temperature controlled. For this purpose, a temperature control device 10 may be arranged to control the temperature of the surface of the transport mechanism 2 (e.g. belt or drum 3) below the inkjet marking module 9. The temperature control device 10 may be used to control the surface temperature of the sheet S within a predetermined range, for example in the range of 30° C. to 60° C. The temperature control device 10 may comprise one or more heaters, e.g. radiation heaters, and/or a cooling means, for example a cold blast, in order to control and maintain the surface temperature of the print medium within the desired range. During and/or after printing, the print medium is conveyed or transported downstream through the inkjet marking module 9.

Post Treatment

To improve or enhance the robustness of a printed image or other properties, such as gloss level, the sheet S may be post treated, which is an optional step in the printing process. For example, in a preferred embodiment, the printed sheets S may be post-treated by laminating the print image. That is, the post-treatment may include a step of applying (e.g. by jetting) a post-treatment liquid onto a surface of the coating layer, onto which the ink has been applied, so as to form a transparent protective layer over the printed recording medium. In the post-treatment step, the post-treatment liquid may be applied over the entire surface of an image on the print medium or it may be applied only to specific portions of the surface of an image. The method of applying the post-treatment liquid is not particularly limited, and may be selected from various methods depending on the type of the post-treatment liquid. However, the same method as used in coating the pre-treatment liquid or an inkjet printing method is preferable. Of these, an inkjet printing method is particularly preferable in view of: (i) avoiding contact between the printed image and the post-treatment liquid applicator; (ii) the construction of an inkjet recording apparatus used; and (iii) the storage stability of the post-treatment liquid. In the post-treatment step, a post-treatment liquid containing a transparent resin may be applied on the surface of a formed image so that a dry adhesion amount of the post-treatment liquid is 0.5 $g/m^2$ to 10 $g/m^2$, preferably 2 $g/m^2$ to 8 $g/m^2$, thereby to form a protective layer on the recording medium. If the dry adhesion amount is less than 0.5 $g/m^2$, little or no improvement in image quality (image density, colour saturation, glossiness and fixability) may be obtained. If the dry adhesion amount is greater than 10 g/m$^2$, on the other hand, this can be disadvantageous from the view-point of cost efficiency, because the dryness of the protective layer degrades and the effect of improving the image quality is saturated.

As a post-treatment liquid, an aqueous solution comprising components capable of forming a transparent protective layer over the print medium sheet S (e.g. a water-dispersible resin, a surfactant, water, and other additives as required) is preferably used. The water-dispersible resin in the post-treatment liquid preferably has a glass transition temperature (Tg) of −30° C. or higher, and more preferably in the range of −20° C. to 100° C. The minimum film forming temperature (MFT) of the water-dispersible resin is preferably 50° C. or lower, and more preferably 35° C. or lower. The water-dispersible resin is preferably radiation curable to improve the glossiness and fixability of the image. As the water-dispersible resin, for example, any one or more of an acrylic resin, a styrene-acrylic resin, a urethane resin, an acryl-silicone resin, a fluorine resin or the like, is preferably employed. The water-dispersible resin can be suitably selected from the same materials as that used for the inkjet ink. The amount of the water-dispersible resin contained, as a solid content, in the protective layer is preferably 1% by mass to 50% by mass. The surfactant used in the post-treatment liquid is not particularly limited and may be suitably selected from those used in the inkjet ink. Examples of the other components of the post-treatment liquid include antifungal agents, antifoaming agents, and pH adjustors.

Hitherto, the printing process was described such that the image formation step was performed in-line with the pre-treatment step (e.g. application of an (aqueous) pre-treatment liquid) and a drying and fixing step, all performed by the same apparatus, as shown in FIG. 1. However, the printing system 1 and the associated printing process are not restricted to the above-mentioned embodiment. A system and method are also contemplated in which two or more separate machines are interconnected through a transport mechanism 2, such as a belt conveyor 3, drum conveyor or a roller, and the step of applying a pre-treatment liquid, the (optional) step of drying a coating solution, the step of ejecting an inkjet ink to form an image and the step or drying an fixing the printed image are performed separately. Nevertheless, it is still preferable to carry out the image formation with the above defined in-line image forming method and printing system 1.

Figure 4:
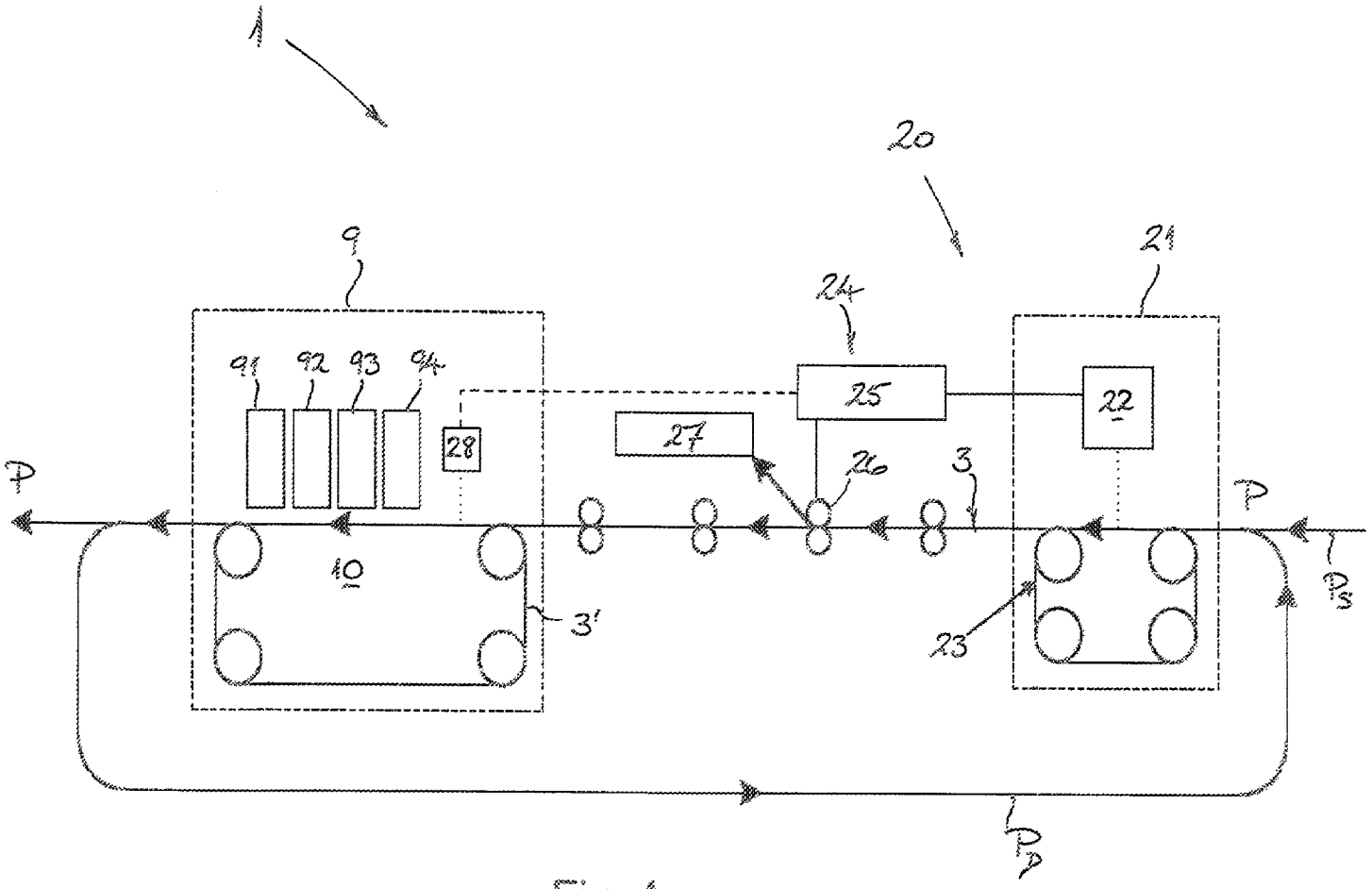
FIG. 4 is a schematic side view of a printing system with a defect detection system according to an embodiment of the invention.

With reference now to FIG. 4 of the drawings, the inkjet printing system 1 according to the preferred embodiment of the invention is shown to include an apparatus 20 for detecting defects in the printing system 1, and particularly for identifying and for classifying deformations D in the sheets S of print medium when the sheets S are on the transport path P of the printing system 1. In this particular embodiment, the apparatus 20 comprises a sensing unit 21, which processes the sheets S on the transport path P before those sheets S enter the image forming device 9. In this regard, it will be noted that the printing system 1 in FIG. 4 has a transport path P which includes both a simplex path $P_S$ and a duplex path $P_D$ and the sensing unit 21 of the apparatus 20 is arranged such that sheets S input on the simplex path $P_S$ and also returning on the duplex path $P_D$ all pass via the sensing unit 21.

At least one first sensor device 22 in the form of an optical sensor, such as a laser scanner, is provided within the sensing unit 21 for sensing the surface geometry or topology of the sheets S as they travel on a first pass or a second pass along the transport path P. The laser scanner or optical sensor device 22 generates digital image data I of the three-dimensional surface geometry or topology of each sheet S sensed or scanned. When performing the sensing or measuring of the surface geometry or topology of the sheets S on the transport path P of printing system 1 with the first sensor device(s) 22, it is highly desirable for the purposes of accuracy and reliability that the sheets S are transported or conveyed in the sensing unit 21 in substantially the same manner as those sheets S are later transported in the image forming unit or marking module 9. To this end, the sensing unit 21 includes a sheet conveyor mechanism 23 that simulates the sheet transport conditions provided by the transport mechanism 3' within the image forming unit 9. In this regard, both the conveyor mechanism 23 and the transport mechanism 3' include a belt transport device with vacuum sheet-holding pressure, as seen in FIG. 4.

The sheet topology data from the first sensor device 22 is then transmitted (e.g. either via a cable connection or wirelessly) to a controller 24 which includes a processor device 25 for processing and analysing the digital image data I to detect and to classify any defect or deformation D in the surface geometry or topology of each sheet S sensed or scanned. The sensing unit 21 is thus arranged to scan the sheets S for detecting and measuring any deformations or defects D before the sheets S enter the image forming device or inkjet marking module 9. In this way, if the processor device 25 determines that a sheet S on the transport path P includes a defect or deformation D that would render the sheet unsuitable for printing, the controller 24 is configured to prevent the sheet S from progressing to the inkjet marking module 9. The sensing unit 21 comprising the first sensor device(s) 22 is therefore desirably provided as a separate sentry unit positioned on the transport path P sufficiently upstream of the marking module 9. The controller 24 and processor device 25 may be integrated within the sentry unit 21 or they may be separately or remotely located.

Drying and Fixing

After an image has been formed on the print medium, the printed ink must be dried and the image must be fixed on the print medium. Drying comprises evaporation of solvents, and particularly those solvents that have poor absorption characteristics with respect to the selected print medium.

FIG. 1 of the drawings schematically shows a drying and fixing unit 11, which may comprise one or more heater, for example a radiation heater. After an image has been formed on the print medium sheet S, the sheet S is conveyed to and passed through the drying and fixing unit 11. The ink on the sheet S is heated such that any solvent present in the printed image (e.g. to a large extent water) evaporates. The speed of evaporation, and hence the speed of drying, may be enhanced by increasing the air refresh rate in the drying and fixing unit 11. Simultaneously, film formation of the ink occurs, because the prints are heated to a temperature above the minimum film formation temperature (MFT). The residence time of the sheet S in the drying and fixing unit 11 and the temperature at which the drying and fixing unit 11 operates are optimized, such that when the sheet S leaves the drying and fixing unit 11 a dry and robust image has been obtained. As described above, the transport mechanism 2 in the fixing and drying unit 11 may be separate from the transport mechanism 2 of the pre-treatment and printing parts or sections of the printing system 1.

Figure 5A:
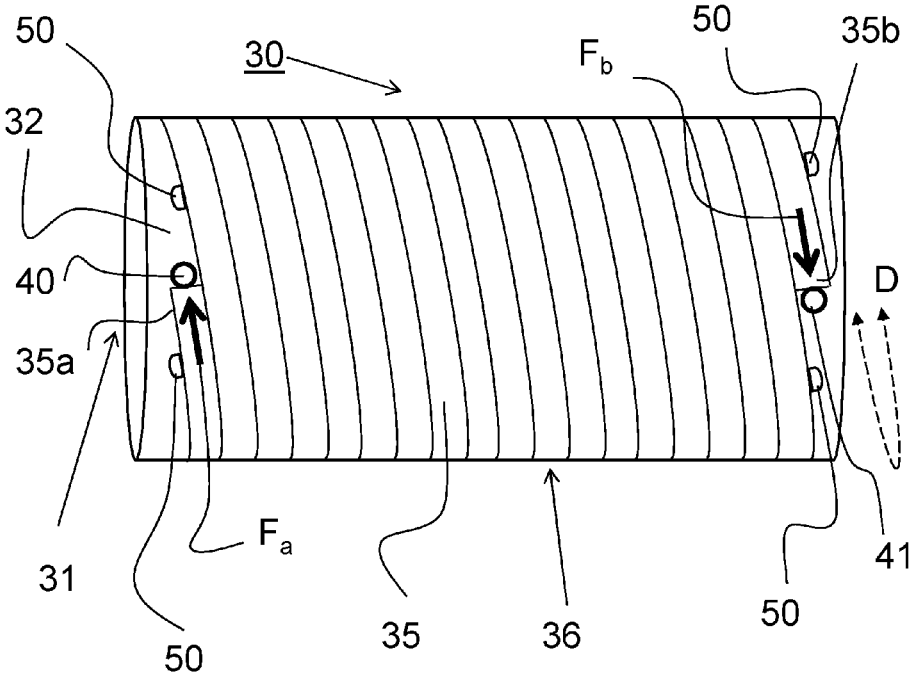
FIG. 5*a-c* are schematic illustrations of a top view (FIG. 5*a*) and side views (FIG. 5*b-c*) of a sheet handling apparatus comprising a drying drum assembly according to the present invention.
Figure 5B:
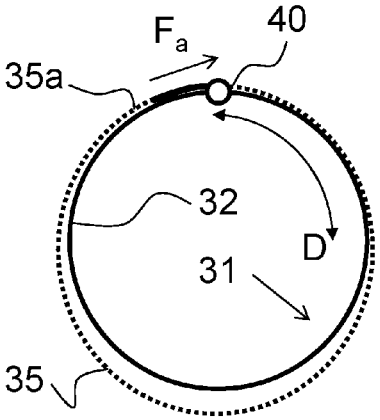
Figure 5C:
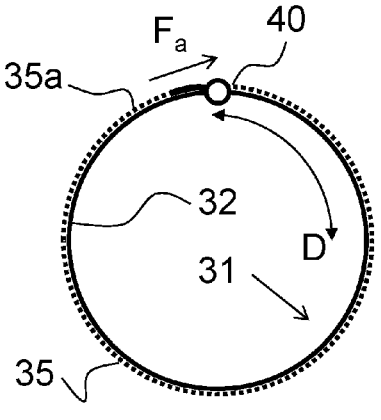

The drying and fixing unit 11 comprises a sheet handling apparatus 30, schematically shown in FIG. 5*a-c*. The sheet handling apparatus 30 comprises a drying drum assembly 100. The drying drum assembly comprises a drying drum 31.

Openings formed by air channels (60 in FIG. 8) are provided in the outer surface 32 of the drum 31, such that air is able to pass through the peripheral wall of the drum 31. A strip 35 is wrapped around the drum 31 in a spiralling pattern. The strip 35 runs over the air channels in the outer surface 32 in a circumferential spiralling direction D. The spiralling direction D comprises a circumferential component and a, preferably small, axial component with respect to the drum 31. When the axial component is very small, for example when a narrow strip 35 is used, the spiralling direction D approximates the circumferential direction of the drum 31. One end 35*a* of the strip 35 is positioned near the in FIG. 5*a* left end of the drum 31. The strip then revolves in adjoining loops around the outer surface 32 of the drum 31 to the in FIG. 5*a* right end of the drum 31. As such, the adjoining loops of the strip 35 form a continuous surface sheet 36 covering the majority of the outer surface 32 of the drum 31. As such the revolved strip 31 forms the screen 36.

Perforations (not shown) are present in the strip 35 to allow air to be sucked through the strip 35 and the outer surface 32 of the drum 31. Air channels 60 are formed in the peripheral wall of the drum 31. The air flow and the suction force through the in the strip 35 and the openings of the air channels 60 into said air channels 60 of the drum 31 are controlled via a suction system (not shown). Sheets present on the screen 36 are held onto the screen 36 via suction. Basically an underpressure in the air channels below the screen results in a vacuum force which pulls the cut sheet media onto the screen 36, such that the sheets follow the circumference of the drum 31. The underpressure and/or vacuum force is adjustable to allow a user to set the forces attracting the sheets towards the peripheral wall of the drum 31, for example for different media types. By removing or reducing the underpressure or vacuum force along a predefined angular of the drum's circumference the sheets can be released from the screen 36.

The tensioning assembly 40, 41 exerts a tensioning force $F_a$, $F_b$ on the strip 35. As such the strip 35 is biased in the spiralling direction D. The tensioning forces $F_a$, $F_b$ on the strip 35 run substantially parallel to the circumferential spiralling direction D of the strip 35. In FIG. 5*a* the tensioning assembly 40, 41 comprises a tensioning device 40, 41 at either end 35*a*, 35*b* of the strip 35. Each tensioning device 40, 41 secures a respective end 35*a*, 35*b* of the strip 35. Additionally, the tensioning devices 40, 41 exert a tensioning force $F_a$, $F_b$ on the ends 35*a*, 35*b*, which force $F_a$, $F_b$ pulls on the free ends 35*a*, 35*b* of the strip 35. Thereby the strip 35 is pulled taut around the drum 31. Since the tensioning devices 40, 41 are oriented in substantially opposite directions to one another in the circumferential spiralling direction D of the strip 35, the tensioning forces $F_a$, $F_b$ pull the strip 35 against the outer surface 32 of the drum 31. Thus, by pulling on the ends 35*a*, 35*b* of the strip 35 the tensioning devices 40, 41 fix the screen in a tight fit around the outer surface 32 of the peripheral wall of the drum 31.

Alternatively a single tensioning device 40, 41 can be provided at one end 35*a*, 35*b* of the strip 35, while the other end 35*a*, 35*b* of the strip 35 is fixed to the drum 31 in a rigid manner. Basically the strip 35 is fixed to the drum 31 at one end 35*a*, 35*b*, while the single tensioning device 40, 41 pulls on the other end 35*a*, 35*b*.

FIG. 5*b*-*c* schematically illustrate the workings of the sheet handling apparatus 30 with the drying drum assembly 100 according to the present invention. During normal operation the sheet 35 and in consequence the screen 36 are wrapped tightly around the outer surface 32 of the peripheral wall of the drum 31. During drying the drum 31 and the screen 36 become heated and will therefore expand. In FIG. 5*b* a situation is shown wherein the screen 36 has expanded more than the drum 31, resulting in the screen 36 being released from the drum 31. However, as shown in FIG. 5*c*, the tensioning device 40 compensates for this thermal expansion difference by pulling on the strip 35 in the direction of the tensioning force $F_a$. In this manner, the thermal expansion differences are overcome yielding a durable yet easily replaceable fixation of the screen 36 onto the drum 31.

Figure 6:
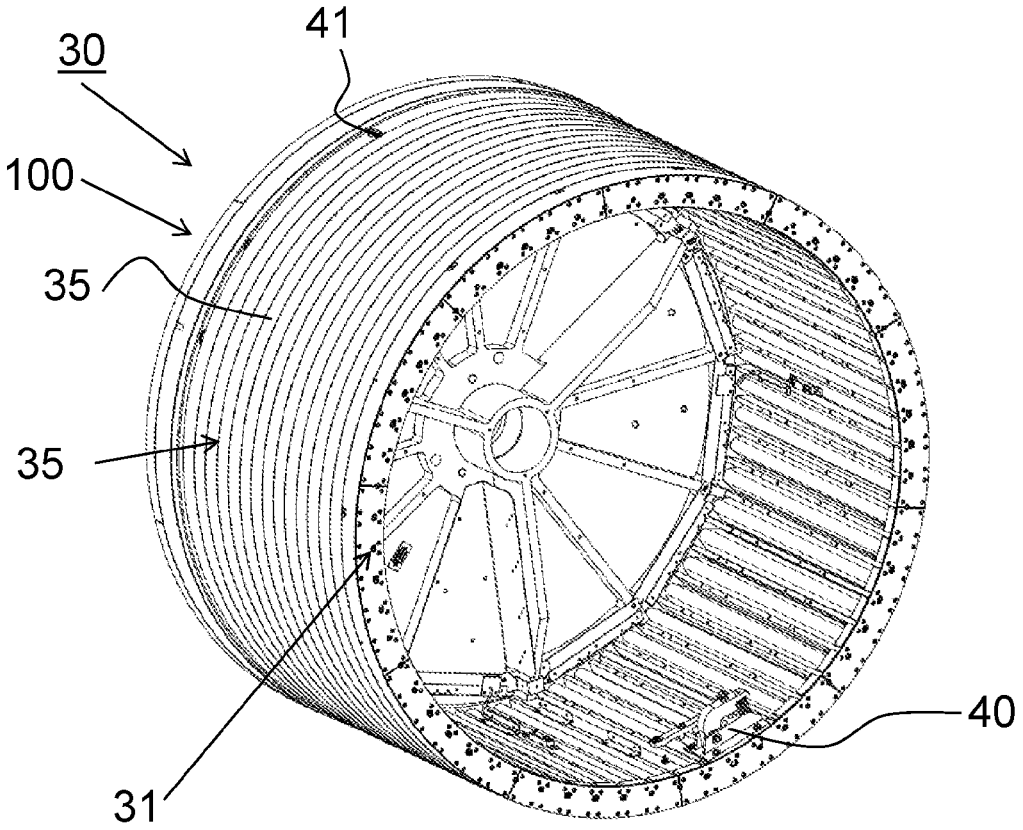
FIG. 6 is a perspective view of a of a sheet handling apparatus comprising a drying drum assembly according to the present invention.

FIG. 6 shows a perspective view of an embodiment of a sheet handling apparatus 30 with a drying drum assembly 100 according to the present invention. The drum 31 is preferably formed of a metal, such as aluminium. The outer surface 31 of the peripheral wall of the drum 31 is provided with openings through which air is able to flow. Similarly, the strip 35 has been provided with small perforations for allowing air to pass through them. Via these perforations sheets can be temporarily fixed onto the outer surface of the screen 36 via a vacuum force.

The strip 35 in FIG. 6 is preferably formed of a metal, such as steel. This metal has preferably been treated by sanding, grinding and/or anodizing to provide a smooth surface. Friction between the strip 35 and the outer surface 32 of the drum 31 is minimized to facilitate an even distribution of the biasing forces through the strip 35. The strip 35 being formed of a different material than the drum 31 is an underlying cause of the difference in thermal expansion between the screen 36 and the drum 31. Alternatively, a temperature difference between the screen 36 and the drum 31 can contribute to the differences in thermal expansion between the drum 31 and the sheet 36.

After attaching an end of the strip 35 to a tensioning device 40, the strip 35 in FIG. 6 has been spiralled around the drum 31, such that the edges of a first loop of the strip 35 are in contact with a proceeding and/or following loop of the strip 35. This results in a relatively smooth surface of the screen 36 and a complete coverage of the respective part of the outer surface 32 of the drum 31. The other end 35*b* of the strip is then attached to a second tensioning device 41, such that the strip 36 is pulled taut around the drum 31 by the tensioning devices 40, 41.

Figure 7:
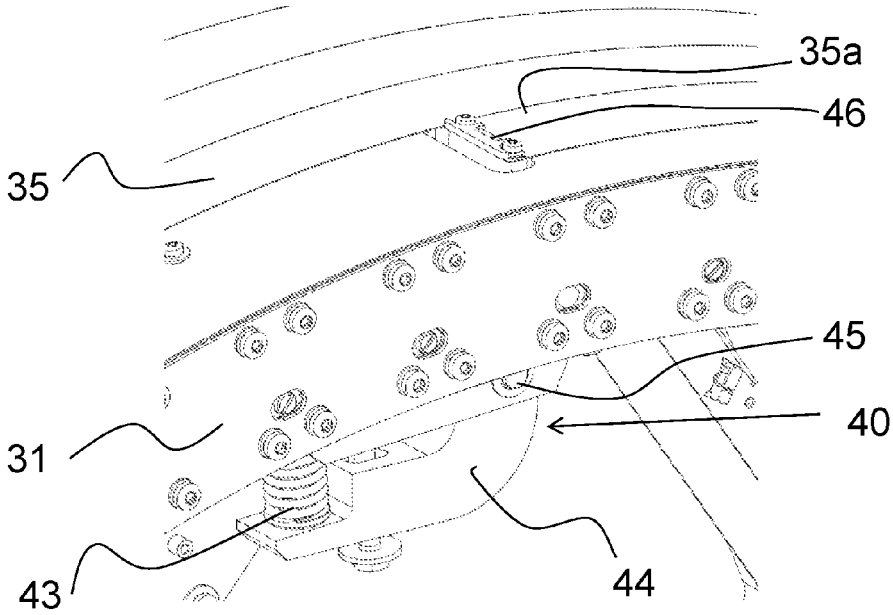
FIG. 7 is a perspective view of a of a tensioning device according to the present invention.
Figure 8:
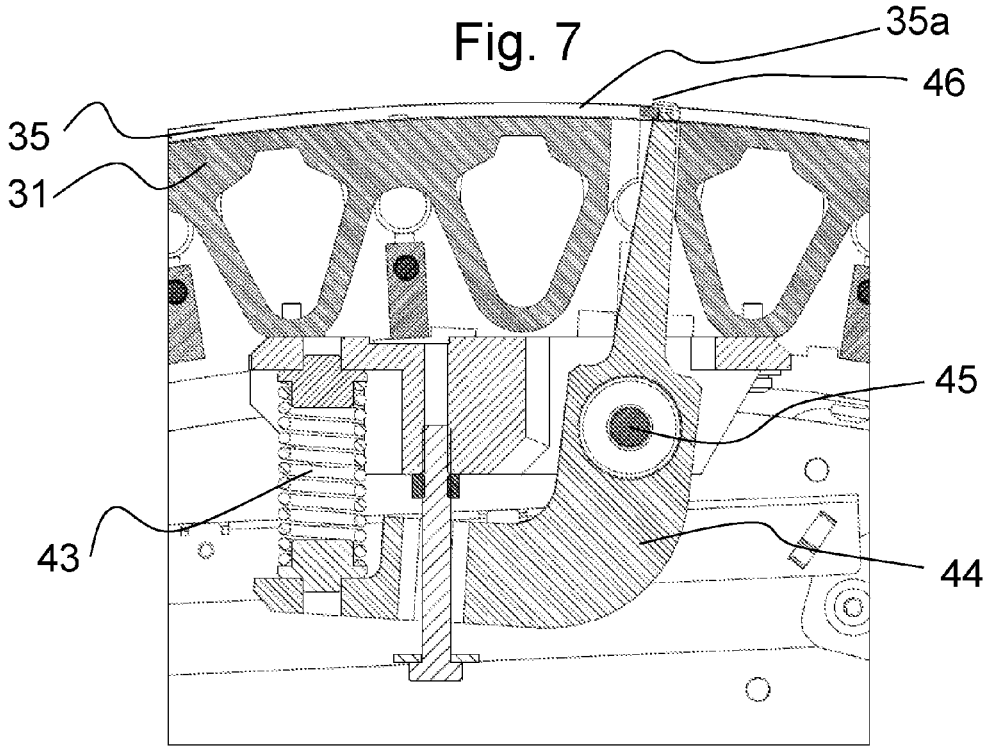
FIG. 8 is a cross-sectional view of a of a tensioning device according to the present invention.

The tensioning device 40 in FIG. 6 extends from inside the drum 31 towards the outer surface 32 of the drum 31 where it 40 engages the strip 35. FIGS. 7 and 8 show a more detailed illustration of the tensioning device 40.

The tensioning device 40 in FIG. 7-8 comprises a lever 44 extending from inside the drum 31 to the outer surface 32. At the outer surface 32 the lever 44 is attached to an end 35*a* of the strip 35, via fixation means 46. In FIG. 7-8 the end 35*a* of the strip 35 is clamped onto the lever 44 by means of a screw 46. Alternatively, clamps or other releasable holding means can be used. Inside the drum 31 the lever 44 is provided on a pivoting axis 45. This pivoting axis 45 is connected to the drum 31 and runs substantially parallel to the rotation axis of the drum 31. As such the lever 44 is able to pivot with respect to the drum 31.

While one end of the lever 44 is connected to the strip 35, the other end of the lever 44 is attached to a spring element 43. The spring element 43 is connected to an adjacent end of the lever to the drum 31. The spring element 43 is able to exert a spring force on the lever 44, which spring force is transferred to the strip 35. By biasing the spring element 43 the strip 35 experiences a continuous tensioning force in the circumferential spiralling direction D. In the embodiment in FIG. 8 the spring force is increased when the end 35*a* moves counter clockwise. When slacking of the strip 35 due to thermal expansion differences between the strip 35 and the drum 31 as in FIG. 5*b* occur, the end 35*a* is moved clockwise by the spring force on the lever 44. The strip 35 is then pulled taut against the outer surface 32. When the drum assembly 100 in the apparatus 30 cools down, the lever 44 returns to its initial position. The spring element 43 can be a spring, leaf spring, or resilient pad. Alternatively, an actuator is provided instead of the spring element 43 for exerting a force on the lever 44.

In FIG. 7 the lever 44 is substantially L-shaped to provide a compact tensioning device 40. The spring element 43 extends substantially in the radial direction and is attached to a first leg of the L-shaped lever 44. This first leg runs locally substantially parallel to the circumferential direction of the drum. The second leg of the L-shaped lever 44 extends substantially in the radial direction of the drum 31 and comprises the pivoting axis 45 and the fixation means 46.

FIG. 8 further illustrates the air channels 60 extending axially (directly) below the screen 35. The radially outward end or side face (top side in FIG. 8) of a channel 60 is open. The openings of the air channels 60 form the openings of the drum 31. The screen or strip 35 is provided over the air channels 60, such that the perforations in the screen 35 are in fluid communication with the air channels 60. The air channels 60 in turn are connected to the suction system (not shown) for sucking in air through the perforations and channels. A perforation in the screen 35 may be positioned directly on a channel 60 (i.e. on the opening of the air channel 60), when viewed in the radial direction. As such, the perforations and an opening of the drum overlap. It will be appreciated that an intermediate chamber may be provided between one or more perforations in the screen and one or more openings of the air channels 60 in the drum 31 to form a fluid connection between the one or more perforations in the screen 35 and the one or more opening of the air channels 60 of the drum 31. The air channels 60 effectively form an air passage or conduit system which extends from a perforation of the screen 35 to the suction system. In an alternative and basic embodiment, the drum 31 with its openings may be formed by a cylinder with perforations in its sidewall.

Figure 9:
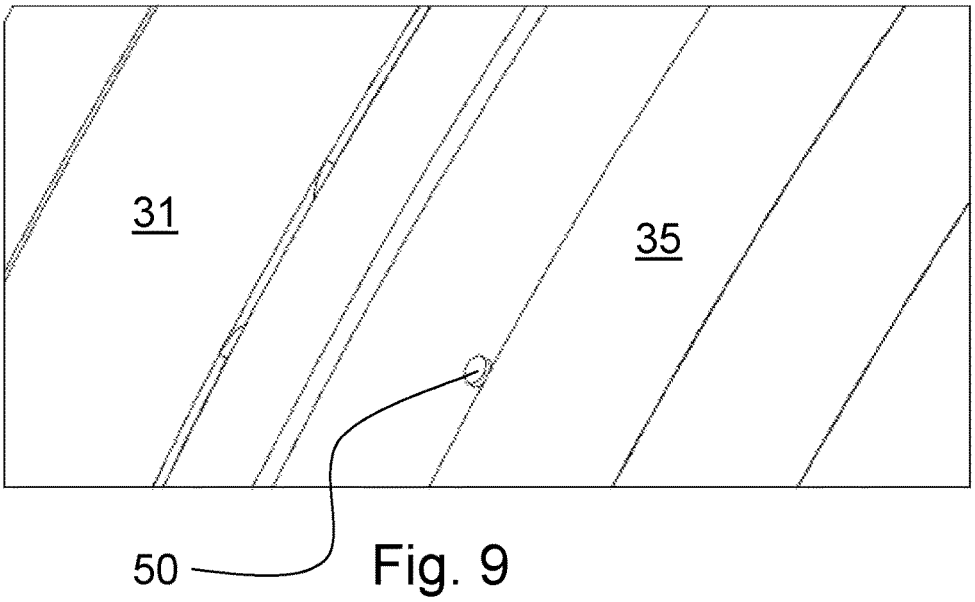
FIGS. 9, 10 are perspective views of stop elements on a comprising a drying drum assembly according to the present invention.
Figure 10:
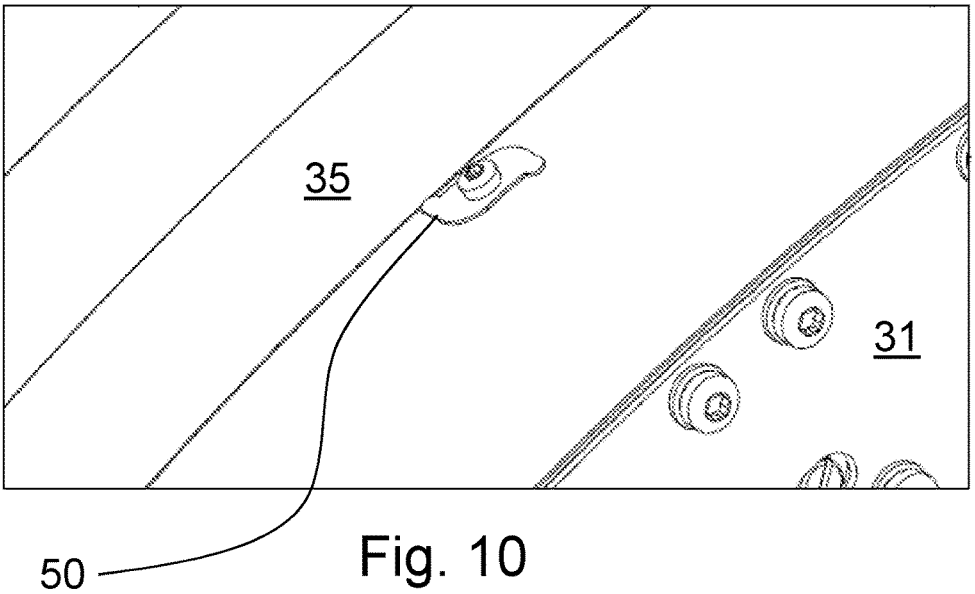

FIGS. 9 and 10 illustrate stop elements 50 which lie against the outer edges of the screen 36. The stop elements extend from the outer surface 32 of the drum 31 and confine the movement of the strip 35 to the circumferential spiralling direction D. This effectively prevents the screen 36 from "wandering" in the axial direction of the drum 31 and keeps the different loops of the strip 35 pressed together. As such a relatively smooth surface of the screen 36 during operation is ensured. The stop elements 50 can be fixed, as in FIG. 9 or adjustable as in FIG. 10. In FIG. 10 the stop element 50 is able to pivot around a axis substantially radial with respect to the drum and can be secured at any desired pivoting angle. Preferably the drum 31 comprises fixed stop elements 50 near the edge of one end of the drum 31, while the stop elements 50 at the other edge of the drum 31 are adjustable. The screen 36 extends between the stop elements 50 at either end of the drum 31. After wrapping the strip 35 around the drum 31 the adjustable stop elements 50 can be used to press the strip 36 together in axial direction of the drum 31. The stop elements 50 can for example be a flange or a plurality of stop elements 50 spaced circumferentially apart from one another.

Although specific embodiments of the invention are illustrated and described herein, it will be appreciated by those of ordinary skill in the art that a variety of alternate and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects. The terms radial, axial, tangential, and circumferential in this description are generally defined with respect to the drum 31, unless stated otherwise.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. Drying drum assembly for a sheet handling apparatus for holding sheets comprising:

a rotary drum having an outer peripheral wall provided with openings;

a strip with perforations formed therein, which strip spirals circumferentially over an outer surface of the peripheral wall of the drum in a circumferential spiralling direction, such that a screen is formed over the peripheral wall of the drum, wherein the openings of the drum and the perforations of the strip are positioned with respect to one another for being in a fluid connection to one another and to a suction system, which suction system is arranged for controlling a flow of air through the openings of the drum and the perforations of the strip to removably fix the sheets on the screen, wherein the strip is biased by means of a tensioning device, which exerts a tensioning force on the strip substantially parallel to the circumferential spiralling direction of the strip.

2. A drying drum assembly according to claim 1, wherein the tensioning device is positioned at an end of the strip.

3. A drying drum assembly according to claim 1, further comprising a tensioning assembly formed by a tensioning device at each end of the strip, wherein the tensioning devices are oriented in substantially opposite directions to one another in the circumferential spiralling direction of the strip.

4. A drying drum assembly according to claim 1, wherein the tensioning device comprises a lever pivotably provided on the drum and connected to the drum via a spring element.

5. A drying drum assembly according to claim 4, wherein during operation the spring element is arranged for exerting a continuous pulling force in the circumferential spiralling direction on the end of the strip via the lever.

6. A drying drum assembly according to claim 1, wherein a tensioning device is positioned near either end of the drum.

7. A drying drum assembly according to claim 1, wherein the tensioning assembly further comprises stop elements adjacent the edges of the screen for limiting the axial movement of the strip over the outer surface of the peripheral wall of the drum.

8. A drying drum assembly according to claim 7, wherein the stop elements are positioned near the edges at the ends of the drum.

9. A drying drum assembly according to claim 1, wherein the strip and drum are formed of materials having different thermal expansion coefficients.

10. A drying drum assembly according to claim 1, wherein the strip and the peripheral wall of the drum are arranged for a free, preferably substantially frictionless, sliding motion of the strip over the outer surface of the peripheral wall of the drum.

11. A drying drum assembly according to claim 1, further comprising air channels provided on the peripheral wall of the drum, which air channels are delimited by the screen.

12. A sheet handling apparatus comprising a drying drum assembly according to claim 1, and further comprising a suction system for controlling a flow of air through the openings of the drum and the strip, thereby to attract sheets towards the peripheral wall of the drum, such that the sheets are removably fixed on the screen.

13. A sheet handling apparatus according to claim 12, further comprising a heating system for heating the sheets on the drying drum assembly drum.

14. Printing system comprising a sheet handling apparatus according to claim 12.

15. Method for producing a drying drum assembly for a sheet handling apparatus according to claim 1, the method comprising the steps of:

attaching a first end of a longitudinal strip formed of a first material to a first tensioning device preferably at an outer surface of a drum formed of a second material, wrapping the strip around the outer surface of the drum in a pattern spiralling over the outer surface of the drum, such that a screen is formed over at least part of the outer surface of the drum, attaching a second end of the longitudinal strip to a second tensioning device preferably at the outer surface of the drum, such that the strip is biased in the circumferential spiralling direction of the strip by means of the tensioning devices.

* * * * *